United States Patent [19]

Huang

[11] 4,406,757

[45] Sep. 27, 1983

[54] ANODIZATION METHOD

[75] Inventor: Jen-chi Huang, Ossining, N.Y.

[73] Assignee: Polychrome Corporation, Yonkers, N.Y.

[21] Appl. No.: 379,590

[22] Filed: May 19, 1982

Related U.S. Application Data

[63] Continuation-in-part of Ser. No. 363,199, Mar. 29, 1982.

[51] Int. Cl.[3] ..... C25D 11/04; C25D 11/02; B41N 1/08

[52] U.S. Cl. ..... 204/58; 204/290 F; 204/28; 101/459

[58] Field of Search ..... 204/58, 290 F, 28; 101/459

[56] References Cited

U.S. PATENT DOCUMENTS

| | | | |
|---|---|---|---|
| Re. 29,754 | 9/1978 | Fromson | 204/28 |
| 3,711,385 | 1/1973 | Beer | 204/290 F |
| 3,915,838 | 10/1975 | Lee | 204/290 F |

FOREIGN PATENT DOCUMENTS

| | | | |
|---|---|---|---|
| 1206863 | 9/1970 | United Kingdom | 204/290 F |

*Primary Examiner*—Charles F. Warren
*Assistant Examiner*—B. J. Boggs, Jr,

[57] ABSTRACT

In the method of electrolytically treating a lithographic-grade aluminum web by liquid contact in a sulfuric acid electrolyte, the improvement which comprises carrying out said treatment in the presence of an iridium oxide plated titanium metal anode.

4 Claims, No Drawings

ANODIZATION METHOD

This application is a continuation-in-part of Ser. No. 363,199, filed Mar. 29, 1982.

BACKGROUND OF THE INVENTION

This invention relates to and has for its objective the electrochemical treatment of lithographic-grade aluminum webs. More particularly, this invention relates to a method for the liquid contact of an aluminum web by the employment of a sulfuric acid electrolyte. More specifically, this invention pertains to a method for the treatment of an aluminum web in a sulfuric acid electrolyte by the employment of an anode comprised of a titanium substrate to which has been uniformly applied an iridium oxide coating.

In the past, many methods have been devised for the anodization of aluminum. One of the most commonly employed methods for the anodization of aluminum involves the use of sulfuric acid as the anodization electrolyte. See, for example, U.S. Pat. No. 3,891,516. This method of electrochemically treating aluminum is especially preferred in the anodization of aluminum webs in the production of photosensitized lithographic printing plates.

The conventional way for anodizing an aluminum web is by treating it with DC current in an acid electrolyte, e.g., 5–20% sulfuric acid. The anodic terminal for the DC current is connected to a metallic roller which supports the aluminum web before it enters the acid electrolyte. The cathodic terminal is, therefore, connected to a metallic cathode which is dipped in the acid electrolyte and a distance is maintained of about 5 inches away from the aluminum web. When the DC current passes through the electrolysis tank the aluminum will be anodized and an oxide layer forms on its surface, so called anodic oxide. In such a way, the DC current should pass through the contact interface of the metallic roller and the aluminum web. As the anoidizing proceeds, oxides will form on the surface of the metallic contact roller, so that the resistance of the interface increases and electric sparks occur. The sparks will cause specks on the surface of the aluminum web. These specks will stay and cause a problem for the aluminum surface when employed as the base of a lithographic printing plate.

To prevent the electric spark at the contact surface, a liquid contact treatment before or after the anodizing tank, has been proposed. Several patents have been granted to W. E. Cooke U.S. Pat. No. 3,471,371 (1969); and H. A. Fromson U.S. Pat. No. 3,929,594 (1975); U.S. Pat. No. 4,021,592 (1977); and U.S. Pat. No. Re. 29, 754 (1978). In liquid contact, the DC current is applied to an anode which is dipped in an electrolyte, the so-called liquid contact cell, before or after the anodizing tank. The anode is kept 5 inches away from the aluminum web in a liquid contact cell in which the electrolyte is usually the same as used in the anodizing tank. The liquid contact solution can be a separated tank or a compartment in the anodizing tank. However, the anode used in the liquid contact section oxidizes quickly. The material of anode used in liquid contact is usually chemical lead and lead alloys. The oxides formed on the lead anode will deteriorate and contaminate the electrolyte. No anodes have been found satisfactory enough to be an anode in the liquid contact cell.

While the liquid contact treatment of aluminum webs in a sulfuric acid electrolyte according to known procedures does yield an aluminum web having advantageous characteristics for its use as a printing plate substrate, these procedures do entail certain drawbacks. One such substantial drawback is the failing of the anodic electrode employed in the liquid contact treatment due to the effect of the highly corrosive sulfuric acid electrolyte employed. Various suggestions have been made to overcome this disadvantage, including the employment of special electrodes which have been alleged to be resistant to anodic attack in the presence of a sulfuric acid electrolyte. For example, suggestions have been made to employ a titanium electrode or an electrode of the platinum group of metals, as in British Pat. No. 1,206,863.

While some of the suggested anodic electrode compositions suggested by the prior art have been successively employed in the electrochemical treament of chloride-containing electrolytes, none have been found to provide satisfactory results in the case of a sulfuric acid electrolyte. Many of the anodes suggested had unsatisfactory life-spans in the sulfuric acid electrolyte and failed in a very short time.

The term "lithographic-grade aluminum webs" as used in this specification and claims is intended to encompass aluminum webs, coils and sheets which are useful for, and manufactured expressly for, the production of lithographic printing plates. Such Aluminum Association Alloys as 1100, 3003 and 1050 have been found to be very suitable for this purpose.

DETAILED DESCRIPTION OF THE INVENTION

It now has been discovered that the liquid contact treatment of an aluminum substrate or web useful in the production of presensitized printing plates may be most satisfactorily performed in a sulfuric acid electrolyte when the anode employed in such a process is comprised of a titanium substrate to which has been uniformly applied an iridium oxide coating. More particularly, it has been found that aluminum webs, suitable for further use in the production of presensitized lithographic printing plates, may be satisfactorily treated in a sulfuric acid electrolyte provided the anode employed in such an anodizing procedure is one which is a dimensionally stable anode comprised of iridium oxide over a titanium substrate. The anodes employed in the practice of the present invention are those commercially from the Electrode Corporation of Chardon, Ohio under the tradename DSA; Engelhard Industries Division, Union, New Jersey; and W. C. Heraeus, GmbH, Dusseldorf, West Germany.

It further has been found that other dimensionally stable anodes, such as ruthenium oxide/titanium or platinized tantalum anodes, were unsuitable in the practice of this invention since they fail in a matter of hours.

The thickness of the iridium oxide coating may range from about 100 to 150 microns, and for most purposes the titanium metal substrate is substantially and uniformly coated with the iridium oxide.

The operating conditions within which the instant invention may be satisfactorily practiced are also important. The concentration of the sulfuric acid in the electrolyte solution should not exceed 40% by weight, generally within the range of about 4 to 22% by weight, and preferably less than 30% by weight. The temperature of the electrolyte solution should not exceed 50° C.

and preferably should be held at less than 45° C. For most purposes temperatures within the range of about 20° to 30° C. may be used. The direct current density may range from about 20 to 400 amps/square foot, and generally should not exceed 400 amps/square foot, with 350 amps/square foot or less being especially preferred in the practice of this invention. Voltage can range from 10 to 30 volts. The anode comprised of iridium oxide over titanium metal has unexpectedly been found to have a life-span in excess of 1000 hours, while other DSA-type anodes failed in less than 15 hours of operation.

This invention may be further illustrated by the following embodiment:

EXAMPLE (A) An iridium oxide over titanium anode (DSA) was placed in a beaker containing a 20% $H_2SO_4$ solution and electric current (DC) was passed through it at a current density of 340 amps per square foot. The electrolyte bath was maintained at an accelerated test temperature of 50°–70° C., which is somewhat higher than the normal operating temperature of less than about 50° C. An aluminum sheet, which acts as the cathode in the liquid contact cell, was immersed in the electrolyte. The anode failed after 1356 hours of continuous use when peeling occurred. At an operating temperature of 30° C. the anode was still active after 6 months. No significant level of contamination was found in the electrolyte either under the accelerated test or the operating temperature conditions. Furthermore, no corrosion and errosion was noted on the indium oxide coated anode.

(B) Anodes comprised of (1) platinized tantalum; (2) platinized niobium (columbium); (3) 30% iridium-70% platinum alloy coated on titanium; (4) 30% iridium-70% platinum alloy coated on tantalum; and (5) ruthenium oxide over titanium were substituted for the iridium oxide over titanium anode of Run A and anodization carried out under the same operating conditions with the following results:

| Anode | Life-Span, Hours |
|---|---|
| 1 | 6 |
| 2 | 2–5 |
| 3 | 14 |
| 4 | 12 |
| 5 | less than 2 |

At the operating temperature of about 30° C. anodes (3) and (4) failed after 3 weeks.

The above data reveal that the iridium oxide plated titanium metal anode's performance was far superior to the other plated anodes.

It will be understood that the foregoing Example is illustrative only and that various changes and modifications can be made in the improved anodization method of this invention without departing from the scope and spirit thereof.

What is claimed is:

1. In a process for electrochemically anodizing a lithographic-grade aluminum web, the improvement which comprises contacting said aluminum web with a sulfuric acid electrolyte in the presence of an anode consisting essentially of iridium oxide uniformly coated over a titanium metal substrate, at a direct current density of less than 400 amps/square foot.

2. In the process of claim 1 wherein the direct current density is from 20 to 400 amps/square foot.

3. In the process of claim 1 wherein the temperature of the electrolyte is maintained at less than about 50° C.

4. In the process of claim 1 wherein the concentration of sulfuric acid the electrolyte is less than about 40% by weight.

* * * * *